US008845079B2

(12) United States Patent
Ozawa

(10) Patent No.: US 8,845,079 B2
(45) Date of Patent: Sep. 30, 2014

(54) LIQUID EJECTING HEAD AND LIQUID EJECTING APPARATUS INCLUDING THE SAME

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/592,185

(22) Filed: Aug. 22, 2012

(65) Prior Publication Data

US 2013/0050343 A1 Feb. 28, 2013

(30) Foreign Application Priority Data

Aug. 24, 2011 (JP) ..... 2011-183135

(51) Int. Cl.
*B41J 2/14* (2006.01)
*B41J 2/045* (2006.01)

(52) U.S. Cl.
CPC ..... *B41J 2/1433* (2013.01); *B41J 2/14233* (2013.01)
USPC ..... 347/47; 347/65; 347/70

(58) Field of Classification Search
USPC ..... 347/47
See application file for complete search history.

(56) References Cited

U.S. PATENT DOCUMENTS

| | | | | |
|---|---|---|---|---|
| 6,412,926 | B1 * | 7/2002 | Okuda | 347/70 |
| 7,048,358 | B2 | 5/2006 | Kubota et al. | |
| 2002/0051039 | A1 * | 5/2002 | Moynihan et al. | 347/68 |
| 2002/0166232 | A1 * | 11/2002 | Fujita et al. | 347/47 |
| 2003/0020796 | A1 * | 1/2003 | Stoffel et al. | 347/105 |
| 2004/0008239 | A1 * | 1/2004 | Kubota et al. | 347/65 |
| 2004/0017430 | A1 * | 1/2004 | Mizuyama et al. | 347/47 |
| 2008/0186360 | A1 | 8/2008 | Zhang | |
| 2009/0225141 | A1 * | 9/2009 | Suzuki | 347/85 |
| 2009/0244200 | A1 * | 10/2009 | Ozawa | 347/68 |
| 2011/0050804 | A1 * | 3/2011 | Otokita | 347/47 |

FOREIGN PATENT DOCUMENTS

| | | |
|---|---|---|
| JP | 2006-290000 | 10/2006 |
| JP | 2009-166242 | 7/2009 |

* cited by examiner

*Primary Examiner* — Shelby Fidler
(74) *Attorney, Agent, or Firm* — Workman Nydegger

(57) ABSTRACT

A nozzle portion in a recording head includes a first nozzle portion of which cross-sectional area is a first area and which is formed at the side of a pressure generation chamber and a second nozzle portion of which cross-sectional area is a second area which is smaller than the first area, which is formed to be continuous to the first nozzle portion through a step portion and of which front end portion is a nozzle opening. Further, when a cross-sectional area of an ink supply path is set to Ss, a cross-sectional area of the first nozzle portion is set to Sn, a flow path resistance of the first nozzle portion is set to Rn', and a flow path resistance of the second nozzle portion is set to Rn, relationships of $Sn/Ss \geq 1/3$ and $Rn'/Rn \leq 0.6$ are satisfied.

6 Claims, 11 Drawing Sheets

LIQUID EJECTING HEAD AND LIQUID EJECTING APPARATUS INCLUDING THE SAME

The entire disclosure of Japanese Patent Application No. 2011-183135, filed Aug. 24, 2011 is expressly incorporated by reference herein.

BACKGROUND

1. Technical Field

The present invention relates to a liquid ejecting head and a liquid ejecting apparatus including the liquid ejecting head, more particularly, relates to a liquid ejecting head and a liquid ejecting apparatus that are usefully applied to a case in which liquid having high viscosity is used.

2. Related Art

As a liquid ejecting apparatus, there is an ink jet recording apparatus including an ink jet recording head. The ink jet recording head includes a plurality of pressure generation chambers, ink supply paths, and nozzle openings. The pressure generation chambers generate pressure for discharging ink droplets by pressure generation units formed by piezoelectric elements, for example. The ink supply paths supply ink individually to each of the pressure generation chambers from a common manifold. The nozzle openings are formed on each of the pressure generation chambers and ink droplets are discharged through the nozzle openings. In the ink jet recording apparatus, discharge energy is applied to ink in the pressure generation chambers communicating with nozzles in response to a print signal so as to cause ink droplets to be discharged through the nozzle openings.

A print target onto which a predetermined text, drawing, or the like is printed by the ink jet recording apparatus of this type includes not only existing paper but also various types of print targets such as plastic and glass and so on. However, existing ink for paper and the like cannot be used sufficiently on a print target having low ink absorbability, such as plastic. That is to say, for example, when printing is performed on plastic with ink which has been used for paper, viscosity (for example, approximately 3.5 (mPa·s) at a normal temperature) of the ink for the paper is too low as ink to be printed on the plastic and there arises a problem in that ink droplets will flow after having landed on the print target depending on cases.

In order to prevent the problem from arising, when printing is performed on a print target having low absorbability, such as plastic, ink having high viscosity (for example, approximately 10.0 (mPa·s) at a normal temperature) has been used.

On the other hand, in particular, in an ink jet recording head in which nozzle portions including nozzle openings are formed on a nozzle plate formed by a silicon single crystal plate among ink jet recording heads, the nozzle portions are formed at two stages in order to lower flow path resistances thereof. That is to say, each nozzle portion in this case has a first nozzle portion and a second nozzle portion. The first nozzle portion is formed at the side of the pressure generation chamber and a cross-sectional area thereof is a first area. The cross-sectional area of the second nozzle portion is a second area which is smaller than the first area. The second nozzle portion is formed to be continuous to the first nozzle portion via a step portion and a front end portion of the second nozzle portion corresponds to a nozzle opening. In the case of the two-stage nozzles, in order to prevent air bubbles from being involved in the nozzle portions during an ink discharge operation, and perform printing with high quality while ensuring discharge stability of ink droplets, the following configuration needs to be employed. That is, a configuration in which vibrating meniscuses are made to be retained on the second nozzle portions so as not to reach the first nozzle portions needs to be employed. Then, the two-stage nozzles of this type are configured such that lengths relating to an ink discharge direction are long at some degree. The flow path resistances of the nozzles which are formed in the silicon single crystal plate in order to make the lengths longer at some degree tend to become large.

When ink having high viscosity is discharged by the ink jet recording head in which the nozzle portions have the two-stage nozzle configurations as described above, discharge performance is inhibited in some cases. This is because the above-described second nozzle portions have not only large inertances but also large flow path resistances.

That is to say, when printing is performed by using ink having high viscosity by the ink jet recording head of the two-stage nozzle system according to an existing technique, there arises the following problems. That is, in such a case, not only an amount of ink droplets to be discharged through nozzle openings becomes small and print quality is adversely affected but also meniscus behavior after discharging is not recovered fast, resulting in an ink discharging cycle being longer, thereby an inhibiting factor for high-speed printing being generated.

The above-described problems are present in not only an ink jet recording head which discharges ink but also a liquid ejecting head which ejects liquid other than ink. In particular, in a liquid head to be used in an industrial application other than printing, there are many opportunities that liquid having high viscosity is ejected and the above-described problems are revealed significantly.

JP-A-2006-290000 (FIG. 1, [0022] to [0027]) is an example of related art.

SUMMARY

An advantage of some aspects of the invention is to provide a liquid ejecting head and a liquid ejecting apparatus including the liquid ejecting head which can ensure a sufficient discharge amount and can contribute to speed-up of printing while meniscus behavior after discharging is made suitable even when liquid having high viscosity is used.

A liquid ejecting head according to an aspect of the invention includes a pressure generation chamber to which liquid is supplied through a liquid supply path, a pressure generation unit that generates a pressure change in the pressure generation chamber, and a nozzle portion that causes the liquid to be discharged with the pressure generated by the pressure generation unit. In the liquid ejecting head, the nozzle portion includes a first nozzle portion of which cross-sectional area in a direction orthogonal to a discharge direction of the liquid is a first area and which communicates with the pressure generation chamber, and a second nozzle portion of which cross-sectional area is a second area smaller than the first area and one side of which communicates with the first nozzle portion and the other side of which is a nozzle opening, and when a cross-sectional area of the liquid supply path in a direction orthogonal to a circulating direction of the liquid is set to Ss, a cross-sectional area of a portion in which the first nozzle portion and the pressure generation chamber communicate with each other is set to Sn, a flow path resistance of the first nozzle portion is set to Rn', and a flow path resistance of the second nozzle portion is set to Rn, relationships of $(Sn/Ss) \geq (1/3)$ and $(Rn'/Rn) \leq 0.6$ are satisfied.

According to the aspect of the invention, the relationship between a ratio of the cross-sectional area Ss of the liquid supply path to the cross-sectional area Sn of the portion on which the first nozzle portion and the pressure generation chamber communicate with each other, and a ratio of the flow path resistance Rn' of the first nozzle portion to the flow path resistance Rn of the second nozzle portion can be optimized at the same time. Therefore, even when liquid having high viscosity is used, a sufficient liquid discharge amount can be ensured and recovery of a meniscus after the discharging can be made suitable. As a result, print quality of printing when liquid having high viscosity is used can be kept to be appropriate and speed-up of printing can be enhanced.

In the above aspect of the invention, it is preferable that when an inertance of the liquid supply path is set to Ms and an inertance of the nozzle portion is set to Mn, a relationship of Mn<Ms be satisfied because in this case, a characteristic of a discharge amount can be improved further. In addition, in the above aspect of the invention, it is preferable that the liquid have a discharge viscosity of equal to or higher than 8.0 (mPa·s) because in this case, desired suitable printing can be also performed on plastic or the like of which surface is smooth and which has no absorbability.

A liquid ejecting apparatus according to another aspect of the invention includes a liquid ejecting head as described above.

With the aspect of the invention, quality of printing which is performed by causing liquid having high viscosity to be discharged on plastic or the like of which surface is smooth and which has no absorbability can be made suitable.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention are described in detail with reference to the drawings.

Figure 1:
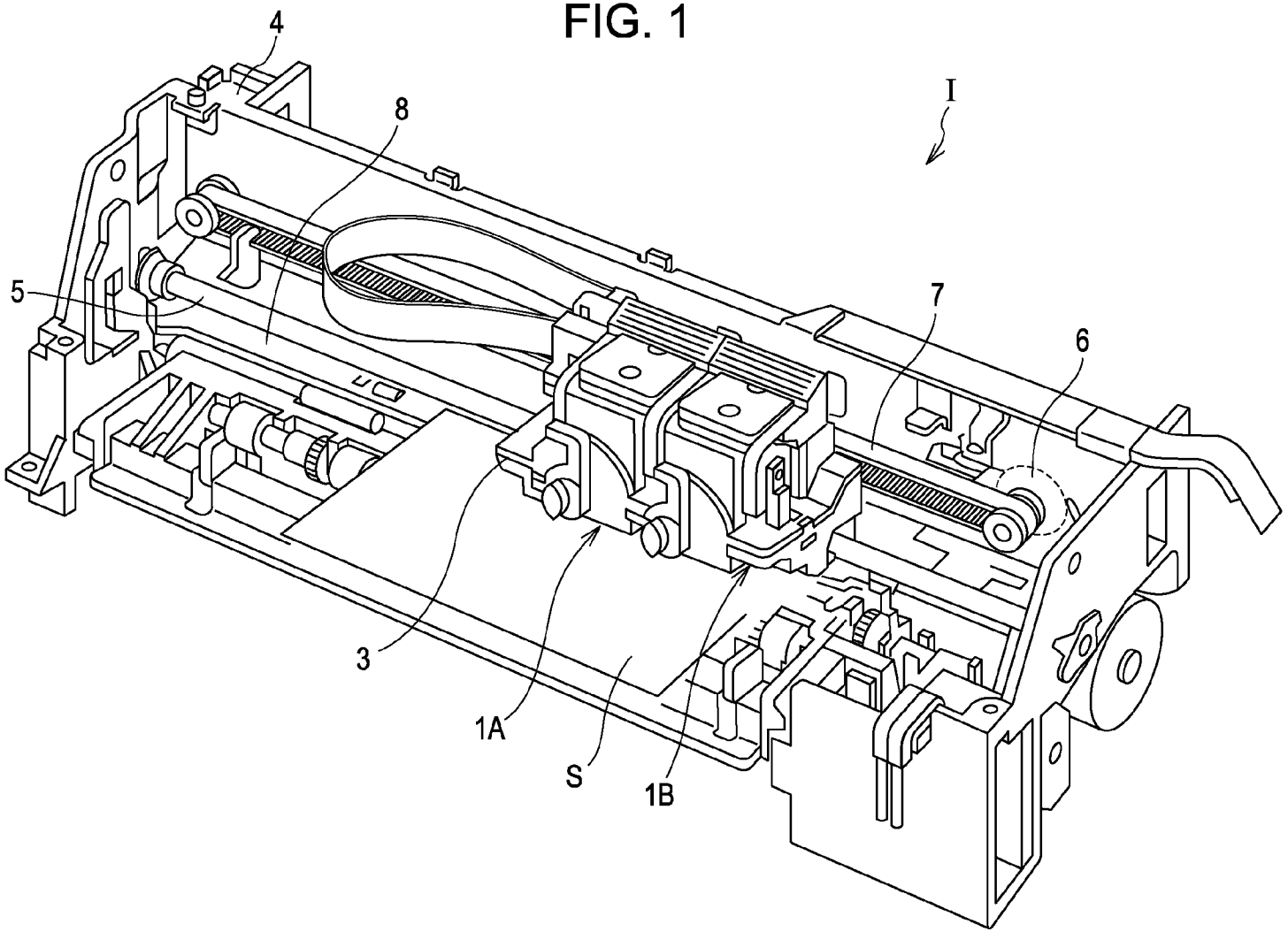
FIG. 1 is a schematic perspective view illustrating a configuration of a liquid ejecting apparatus.

FIG. 1 is a schematic view illustrating an example of an ink jet recording apparatus (hereinafter, also referred to as recording apparatus). As illustrated in FIG. 1, recording head units 1A and 1B are provided on an ink jet recording apparatus I as a liquid discharging apparatus. That is to say, the recording head units 1A and 1B are mounted on a carriage 3 of the ink jet recording apparatus I, and the carriage 3 is provided on a carriage shaft 5 attached to an apparatus main body 4 of the ink jet recording apparatus I so as to be movable in a shaft direction. The recording head units 1A and 1B discharge a black ink composition and a color ink composition, respectively, for example. Ink having high viscosity (for example, 8 mPa·s) is used.

A driving force of a driving motor 6 is transmitted to the carriage 3 through a plurality of gears (not illustrated) and a timing belt 7 so that the carriage 3 on which the recording head units 1A and 1B are mounted is moved along the carriage shaft 5. On the other hand, a platen 8 is provided on the apparatus main body 4 along the carriage shaft 5. A recording sheet S as a recording medium such as paper fed by a paper feeding roller (not illustrated in FIG. 1) and the like is transported while being wound over the platen 8.

Figure 2:
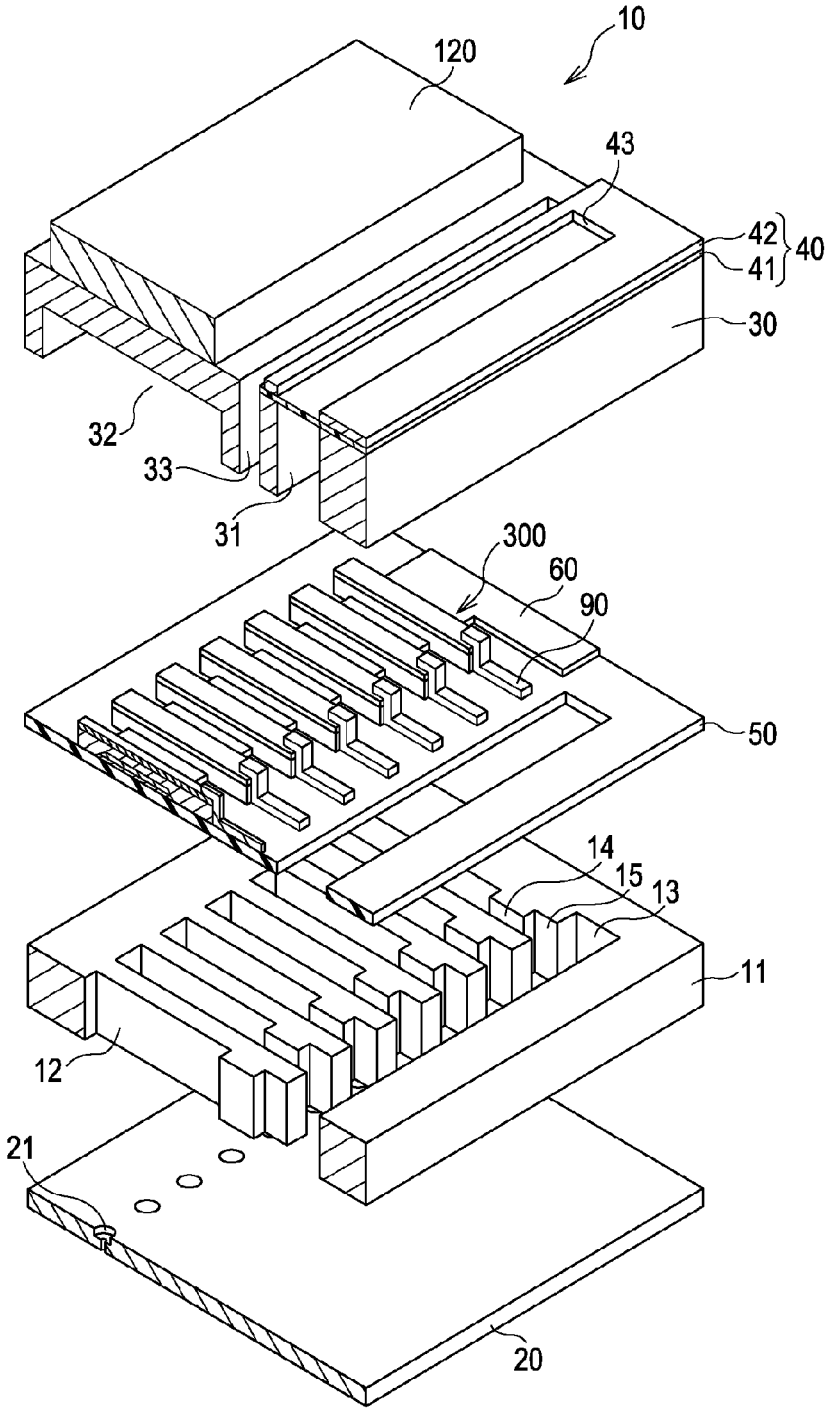
FIG. 2 is an exploded perspective view illustrating a schematic configuration of a recording head according to the embodiment.
Figure 3:
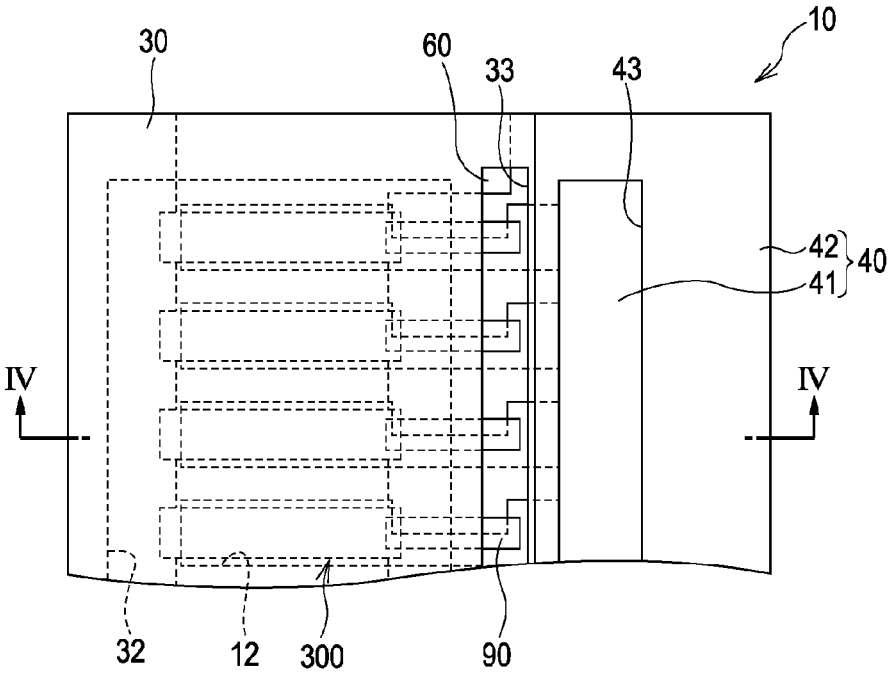
FIG. 3 is a plan view of FIG. 2.
Figure 4:
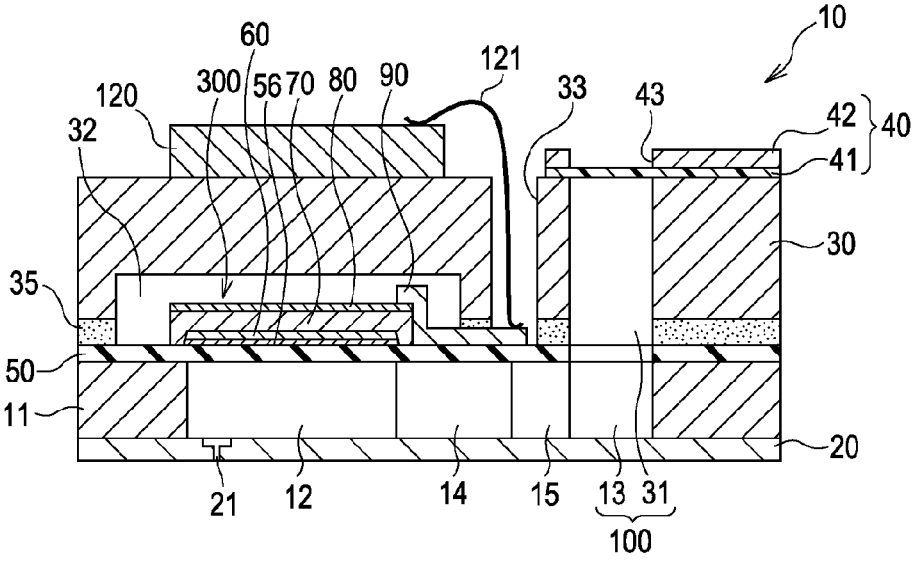
FIG. 4 is a cross-sectional view cut along a line IV-IV of FIG. 3.

FIG. 2 is an exploded perspective view illustrating a schematic configuration of an ink jet recording head (hereinafter, also referred to as recording head) which is incorporated in each of the recording head units 1A and 1B as illustrated in FIG. 1. FIG. 3 is a plan view of FIG. 2. FIG. 4 is a cross-sectional view cut along a line IV-IV of FIG. 3.

As illustrated in FIG. 2 to FIG. 4, a flow path formation substrate 11 of a recording head 10 is formed of a silicon single crystal substrate. An elastic film 50 which is formed with silicon dioxide and serves as a vibrating portion in the embodiment is formed on one surface of the flow path formation substrate 11 of the recording head 10. A plurality of pressure generation chambers 12 are arranged on the flow path formation substrate 11 in parallel in the width direction thereof. A communicating portion 13 is formed on a region at the outer side of the pressure generation chambers 12 on the flow path formation substrate 11 in the lengthwise direction thereof. The communicating portion 13 and each of the pressure generation chambers 12 communicate with each other through ink supply paths 14 and communicating paths 15. The ink supply path 14 and the communicating path 15 are provided for each pressure generation chamber 12. The communicating portion 13 communicates with a manifold portion 31 on a protection substrate 30, which will be described later, so as to constitute a part of a manifold 100 as a common ink chamber of each of the pressure generation chambers 12. The ink supply paths 14 are formed to have widths which are narrower than the pressure generation chambers 12 and keep a flow path resistance of ink flowing into the pressure generation chambers 12 from the communicating portion 13 to be constant. In the embodiment, the ink supply paths 14 are formed by narrowing widths of flow paths from one side. However, the ink supply paths 14 may be formed by narrowing the widths of the flow paths from both sides. Alternatively, the ink supply paths may be formed not by narrowing the widths of the flow paths but by narrowing the flow paths from the thickness direction. In this manner, in the embodiment, liquid flow paths constituted by the pressure generation chambers 12, the communicating portion 13, the ink supply paths 14, and the communicating paths 15 are provided on the flow path formation substrate 11 and the pressure generation chambers 12 are filled with ink.

Further, a nozzle plate 20 is fixed and adhered to an opening surface side as one surface of the flow path formation substrate 11 with an adhesive, a thermal welding film, or the like. Nozzle portions 21 communicating with the vicinities of ends of each of the pressure generation chambers 12 at a side opposite to the ink supply paths 14 are provided on the nozzle plate 20 in a punctured manner. The nozzle plate 20 in the embodiment is formed of a silicon single crystal substrate and the nozzle portions 21 have a two-stage nozzle configuration like most of the nozzle portions 21 which are provided on the nozzle plate formed by a silicon single crystal substrate in a punctured manner. The two-stage nozzle configuration is described in detail later.

The elastic film 50 is formed on an opening surface of the flow path formation substrate 11 at the opposite side as described above. An adhesion layer 56 for improving adhesiveness of a first electrode 60 to an underlayer such as the elastic film 50 is provided on the elastic film 50. The adhesion layer 56 is formed with titanium oxide or the like having a thickness of approximately 30 to 50 nm, for example. It is to be noted that an insulating film formed with zirconium oxide or the like may be provided on the elastic film 50 if needed.

Further, the first electrode 60, piezoelectric layers 70, and second electrodes 80 are formed on the adhesion layer 56 in a laminated manner so as to constitute piezoelectric elements 300. The piezoelectric layers 70 are thin films each having a thickness of equal to or less than 2 μm, preferably, 0.3 to 1.5 μm. The piezoelectric elements 300 correspond to pressure generation units in the embodiment and indicate portions including the first electrode 60, the piezoelectric layers 70, and the second electrodes 80. In general, any one electrode of piezoelectric elements 300 is set to a common electrode and the other electrode and the piezoelectric layer 70 thereof are patterned for each pressure generation chamber 12. In the embodiment, the first electrode 60 is set to a common electrode to the piezoelectric elements 300 and the second electrodes 80 are set to individual electrodes of the piezoelectric elements 300. However, no problem arises even if these electrodes are made to be switched for the convenience of driving circuits and wirings. Further, the piezoelectric elements 300 and a vibration plate which is deformed by driving the piezoelectric elements 300 are referred to as an actuator apparatus collectively. It is to be noted that in the above-described example, the elastic film 50, the adhesion layer 56, the first electrode 60, and the insulating film which is provided if needed operate as the vibration plate. However, it is needless to say that the vibration plate is not limited thereto. For example, the elastic film 50 and the adhesion layer 56 may not be provided. Alternatively, the piezoelectric elements 300 themselves may also serve as the vibration plate practically.

Lead electrodes 90 are connected to the second electrodes 80 as the individual electrodes of the piezoelectric elements 300. The lead electrodes 90 are drawn from the vicinities of ends of the piezoelectric elements 300 at the side of the ink supply paths 14 and are extended onto the elastic film 50 and the insulating film which is provided if needed. The lead electrodes 90 are formed with gold (Au) or the like, for example.

A protection substrate 30 is bonded onto the flow path formation substrate 11 on which the piezoelectric elements 300 are formed with an adhesive 35. That is to say, the protection substrate 30 is bonded onto the first electrode 60, the elastic film 50, the insulating film that is provided if needed, and the lead electrodes 90. The protection substrate 30 includes the manifold portion 31 constituting at least a part of the manifold 100. In the embodiment, the manifold portion 31 penetrates through the protection substrate 30 in the thickness direction and is formed across the width direction of the pressure generation chambers 12. Further, the manifold portion 31 communicates with the communicating portion 13 on the flow path formation substrate 11 so as to constitute the manifold 100 as the common ink chamber to each of the pressure generation chambers 12. Alternatively, the communicating portion 13 on the flow path formation substrate 11 may be divided into a plurality of communicating portions each of which corresponds to each of the pressure generation chambers 12 so that only the manifold portion 31 constitutes the manifold. Further, for example, only the pressure generation chambers 12 may be provided on the flow path formation substrate 11. In this case, the ink supply paths 14 which make the manifold 100 and the pressure generation chambers 12 communicate with each other may be provided on a member (for example, elastic film 50, insulating film which is provided if needed, or the like) interposed between the flow path formation substrate 11 and the protection substrate 30.

A piezoelectric element holding portion 32 is provided on the protection substrate 30 on a region which is opposed to the piezoelectric elements 300. The piezoelectric element holding portion 32 has a space so as not to inhibit motions of the piezoelectric elements 300. It is sufficient that the piezoelectric element holding portion 32 has a space so as not to inhibit the motions of the piezoelectric elements 300 and the space may be sealed or may not be sealed.

As a material of the protection substrate 30, it is preferable that a material which has substantially the same thermal expansion coefficient as that of the flow path formation substrate 11, for example, glass, a ceramic material, or the like, be used. In the embodiment, the protection substrate 30 is formed by using a silicon single crystal substrate that is the same material as the flow path formation substrate 11.

Further, a through-hole 33 that penetrates through the protection substrate 30 in the thickness direction is provided on the protection substrate 30. The vicinities of ends of the lead electrodes 90 which are drawn from the piezoelectric elements 300 are configured so as to be exposed in the through-hole 33.

On the other hand, a driving circuit 120 which is controlled by a controller (not illustrated in FIG. 2 to FIG. 4), which will be described in detail later, and drives the piezoelectric elements 300 is fixed onto the protection substrate 30. As the driving circuit 120, a circuit substrate, for example a semiconductor integrated circuit (IC), or the like can be used, for example. Further, the driving circuit 120 and the lead electrodes 90 are electrically connected to each other through connection wires 121 formed by conductive wires such as bonding wires.

In addition, a compliance substrate 40 is bonded onto the protection substrate 30. The compliance substrate 40 is constituted by a sealing film 41 and a fixing plate 42. Note that the sealing film 41 is made of a material having flexibility and low rigidity and one surface of the manifold portion 31 is sealed by the sealing film 41. Further, the fixing plate 42 is made of a relatively hard material. A region of the fixing plate 42, which is opposed to the manifold 100, corresponds to an opening 43 in which the fixing plate 42 is completely removed in the thickness direction. Therefore, one surface of the manifold 100 is sealed only by the sealing film 41 having flexibility.

Figure 5:
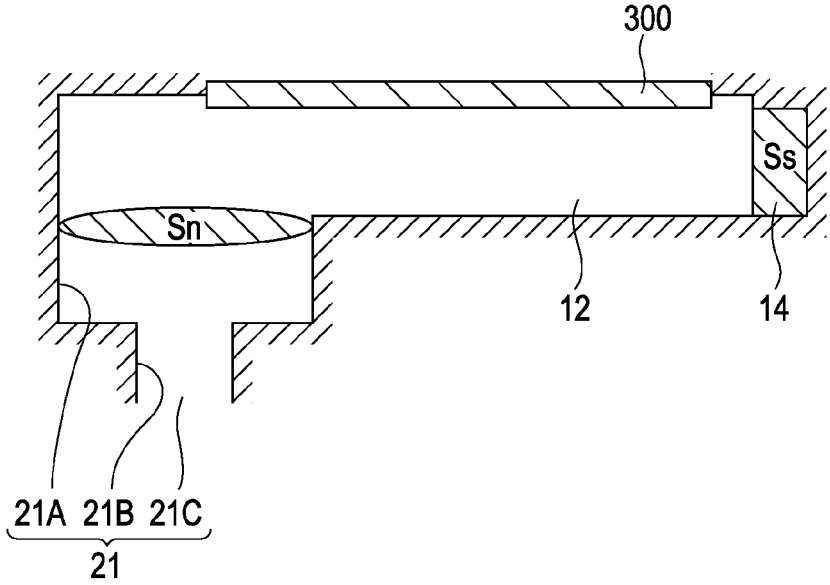
FIG. 5 is a view schematically illustrating a pressure generation chamber and a nozzle portion in FIG. 3 that are extracted and enlarged.

FIG. 5 is a view schematically illustrating the pressure generation chamber and the nozzle portion in FIG. 3 that are extracted and enlarged. In FIG. 5, the same reference numerals denote the same parts as those in FIG. 3 and overlapped explanation thereof is omitted.

As illustrated in FIG. 5, each nozzle portion 21 in the embodiment has a two-stage configuration in which a first nozzle portion 21A and a second nozzle portion 21B are continuous to each other through a step portion. A cross-sectional area of the first nozzle portion 21A in a direction orthogonal to an ink discharge direction is a first area and the first nozzle portion 21A is formed at the side of the pressure generation chamber 12. The cross-sectional area of the second nozzle portion 21B is a second area which is smaller than the first area and a front end portion of the second nozzle portion 21B corresponds to a nozzle opening 21C.

Further, when a cross-sectional area of each ink supply path 14 in the direction orthogonal to the circulating direction of the ink is set to Ss, the cross-sectional area of each first nozzle portion 21A is set to Sn, a flow path resistance of each first nozzle portion 21A is set to Rn', and a flow path resistance of each second nozzle portion 21B is set to Rn, relationships of $Sn/Ss \geq 1/3$ and $Rn'/Rn \leq 0.6$ are satisfied. Further, in the embodiment, when an inertance of each ink supply path 14 is set to Ms and an inertance of each nozzle portion 21 is set to Mn, a relationship of $Mn < Ms$ is satisfied.

In the recording head 10 of the embodiment, ink is taken in from an ink introduction port connected to an external ink supply unit (not illustrated) and ink is filled into an inner portion from the manifold 100 to the nozzle portions 21. Thereafter, voltage is applied to between the first electrode 60 and the second electrodes 80 which correspond to the pressure generation chambers 12 in accordance with a driving signal from the driving circuit 120 respectively. This flexurally deforms the elastic film 50, the adhesion layer 56, the first electrode 60, and the piezoelectric layers 70 so that vibration with the deformation is transmitted to ink in the pressure generation chambers 12 through the elastic film 50 functioning as the vibrating portion. As a result, pressure in the pressure generation chambers 12 is increased so that ink droplets are discharged through the nozzle openings 21C of the nozzle portions 21.

At this time, in the embodiment, the relationship between the ratio of the cross-sectional area Ss of each ink supply path 14 to the cross-sectional area Sn of each first nozzle portion 21A, and the ratio of the flow path resistance Rn' of each first nozzle portion 21A to the flow path resistance Rn of each second nozzle portion 21B is optimized at the same time. Therefore, a sufficient ink discharge amount and a discharge speed can be obtained even when ink having high viscosity is used. Further, recovery of meniscuses after discharging can be made stable and suitable. In addition, in the embodiment, since the inertance Mn of each nozzle portion 21 is set to be smaller than the inertance Mn of each ink supply path 14, an ink discharge amount through the nozzle portion 21 can be made sufficiently larger.

FIG. 6 to FIG. 10 are graphs illustrating a calculated value of an ink discharge characteristic of the recording head. Each discharge characteristic indicates behavior of a meniscus over time in the nozzle portion 21. That is to say, a horizontal axis indicates time (μs) and a vertical axis indicates a position of the meniscus. A point of origin 0 indicates a nozzle surface, a positive side in the vertical direction indicates a discharge surface, and a negative side in the vertical direction indicates a direction of the pressure chamber. The unit is $m^3$. Further, characteristics as illustrated in FIG. 6 to FIG. 10 indicate characteristics when ink droplets are discharged with a driving signal of 1 kHz. In each drawing, a maximum value in the vertical direction indicates a discharge amount of ink droplets. Note that the discharge amount is obtained by converting a maximum value at the positive side at a maximum meniscus position to a discharge weight virtually. As the meniscus position is larger, a weight of ink to be discharged becomes larger.

Figure 8:
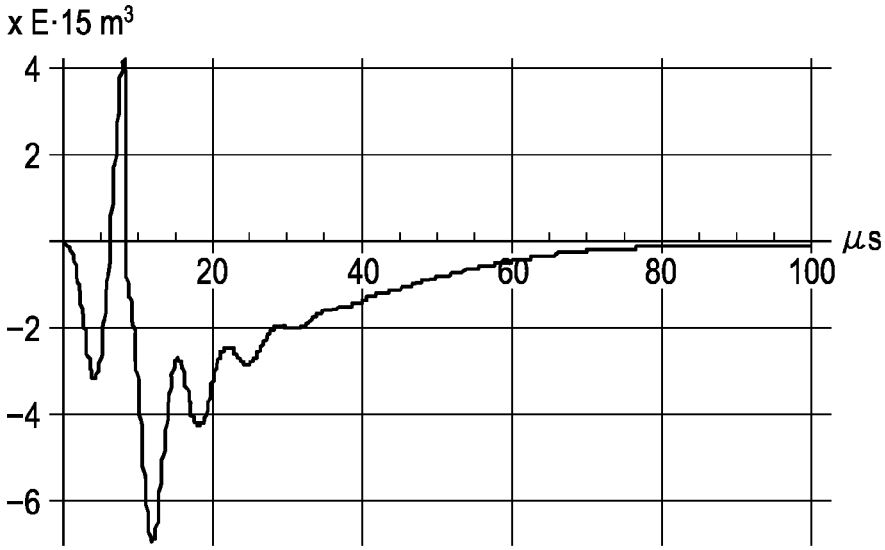
FIG. 8 is a graph illustrating a calculated value of an ink discharge characteristic of the recording head.
Figure 9:
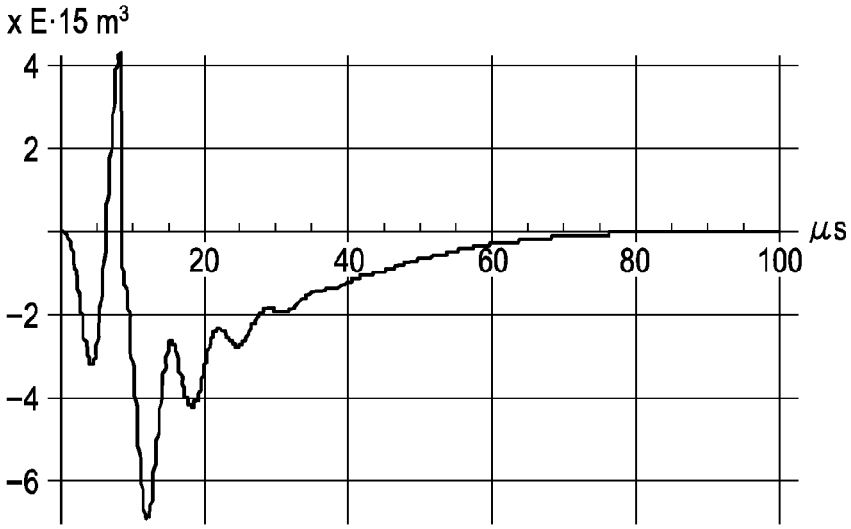
FIG. 9 is a graph illustrating a calculated value of an ink discharge characteristic of the recording head.
Figure 10:
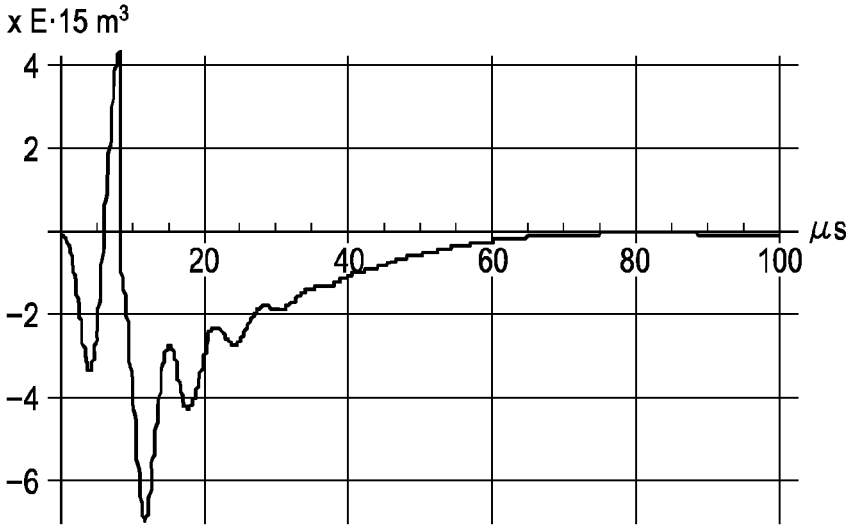
FIG. 10 is a graph illustrating a calculated value of an ink discharge characteristic of the recording head.

For characteristics as illustrated in the drawings, the ratio (Sn/Ss) of the cross-sectional area Ss of each ink supply path 14 to the cross-sectional area Sn of each first nozzle portion 21A is set to a predetermined value and the ratio (Rn'/Rn) of the flow path resistance Rn' of each first nozzle portion 21A to the flow path resistance Rn of each second nozzle portion 21B is changed. That is to say, in FIG. 6, the ratio (Rn'/Rn) is set to 0.783333 while the ratio (Sn/Ss) is set to a predetermined value which is smaller than 1/3. In the same manner, in FIG. 7, the ratio (Rn'/Rn) is set to 0.58 while the ratio (Sn/Ss) is set to a predetermined value which is smaller than 1/3. In FIG. 8, the ratio (Rn'/Rn) is set to 0.51 while the ratio (Sn/Ss) is set to a predetermined value which is equal to or larger than ⅓. In FIG. 9, the ratio (Rn'/Rn) is set to 0.45 while the ratio (Sn/Ss) is set to a predetermined value which is equal to or larger than 1/3. In FIG. 10, the ratio (Rn'/Rn) is set to 0.38 while the ratio (Sn/Ss) is set to a predetermined value which is equal to or larger than 1/3.

Figure 6:
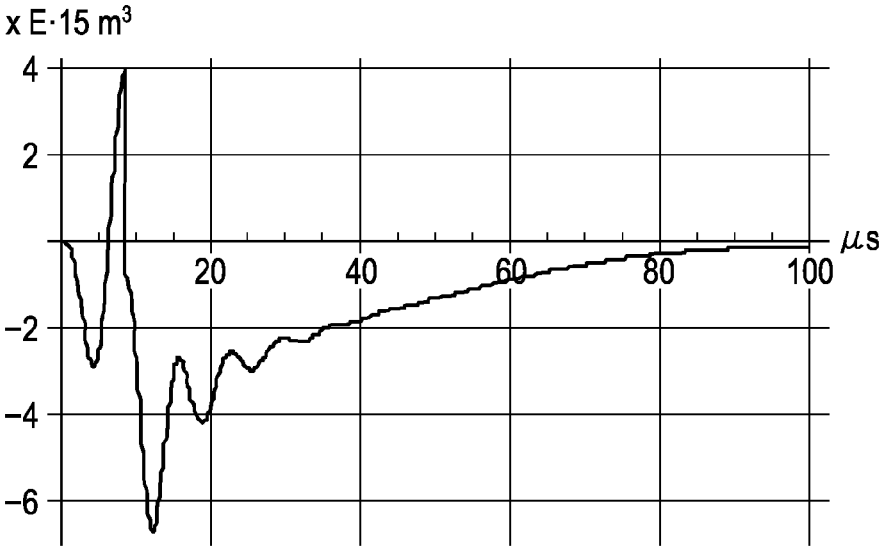
FIG. 6 is a graph illustrating a calculated value of an ink discharge characteristic of the recording head.

In the case of FIG. 6, the meniscus takes approximately 90 μs to recover and the discharge amount is approximately 4 pl. That is to say, a refill characteristic (meniscus recovery characteristic) is poor and the discharge amount is not sufficient at the same time. Accordingly, when the ratio (Sn/Ss) is smaller than 1/3 and the ratio (Rn'/Rn) is 0.78 which is larger than 0.6, both of the refill characteristic and the discharge characteristic have difficulties.

Figure 7:
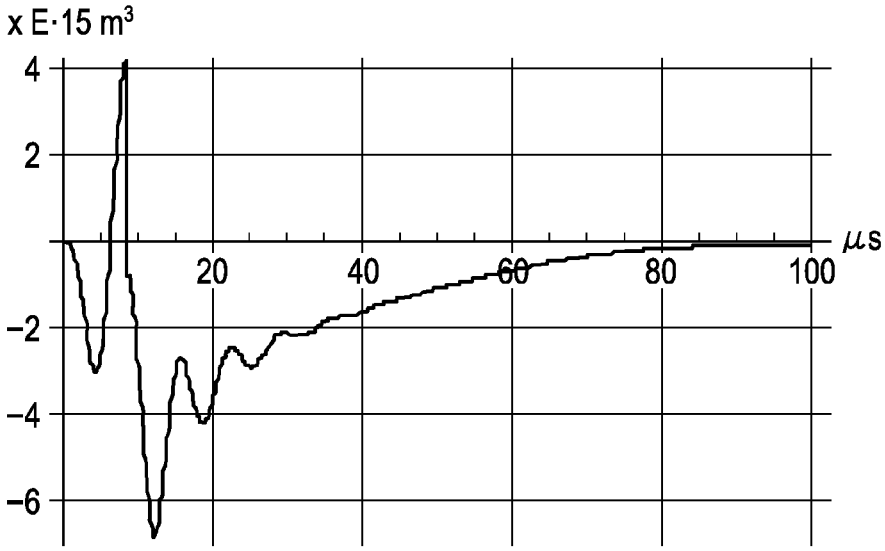
FIG. 7 is a graph illustrating a calculated value of an ink discharge characteristic of the recording head.

In the case of FIG. 7, the meniscus takes approximately 85 μs to recover and the discharge amount is approximately slightly larger than 4 pl. That is to say, the refill characteristic is not sufficient and the discharge amount is not also sufficient at the same time. Accordingly, when the ratio (Rn'/Rn) is 0.58 which is smaller than 0.6 but the ratio (Sn/Ss) is smaller than 1/3, sufficient characteristics are not obtained.

In any of the cases of FIG. 8 to FIG. 10, the meniscus takes equal to or shorter than 80 μs to recover and the discharge amount is stably larger than 4 pl. That is to say, both of the refill characteristic and the discharge amount are preferable. Further, it is also found that as the ratio (Rn'/Rn) is smaller, the refill characteristic is improved. Accordingly, it is also found that when the ratio (Sn/Ss) is equal to or larger than 1/3, and the ratio (Rn'/Rn) is equal to or smaller than 0.6, sufficient characteristics are obtained.

It is to be noted that even if the ratio (Sn/Ss) is equal to or larger than 1/3, when the ratio (Rn'/Rn) is larger than 0.6, ink is refilled but sufficient discharge speed cannot be obtained.

The above-described results are summarized in the following Table.

TABLE

| | | Rn'/Rn | |
|---|---|---|---|
| | | ≤0.6 | >0.6 |
| Sn/Ss | <1/3 | NOT SO GOOD NOT REFILLED, DISCHARGE AMOUNT IS NOT SUFFICIENT | POOR NOT REFILLED, DISCHARGE DIFFICULTY |
| | ≥1/3 | EXCELLENT SUFFICIENT CHARACTERISTICS ARE OBTAINED | NOT SO GOOD REFILLED BUT DISCHARGE SPEED IS NOT SUFFICIENT |

Figure 11:
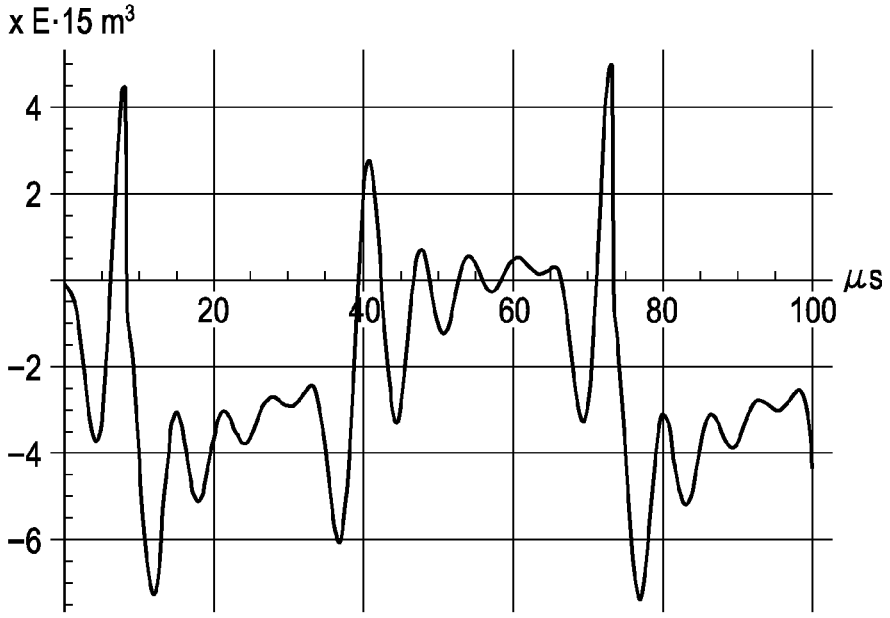
FIG. 11 is a graph illustrating a calculated value of an ink discharge characteristic of the recording head.
Figure 12:
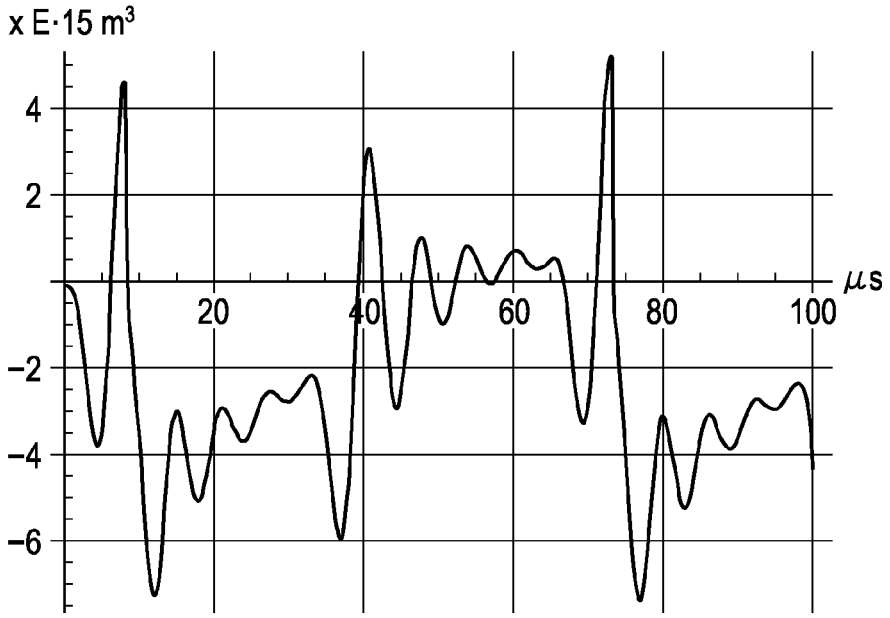
FIG. 12 is a graph illustrating a calculated value of an ink discharge characteristic of the recording head.
Figure 13:
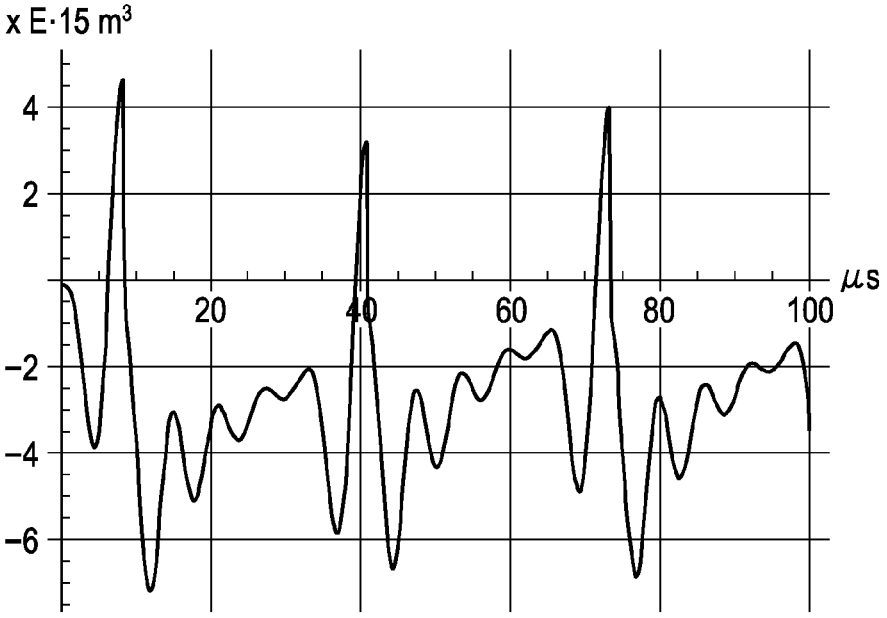
FIG. 13 is a graph illustrating a calculated value of an ink discharge characteristic of the recording head.

FIG. 11 to FIG. 16 illustrate ink discharge characteristics of the recording head when ink droplets are discharged with a driving signal of 30 kHz similar to those in FIG. 6 to FIG. 10. In FIG. 11 and FIG. 12, the ratio (Sn/Ss) is smaller than 1/3 and the ratio (Rn'/Rn) is larger than 0.6. In addition, in FIG. 11, the ratio (Sn/Ss) is smaller than that in FIG. 12 and the ratio (Rn'/Rn) is larger than that in FIG. 12. Further, in FIG. 13 to FIG. 16, the ratio (Sn/Ss) is equal to or larger than 1/3 and the ratio (Rn'/Rn) is equal to or smaller than 0.6. Moreover, the ratio (Sn/Ss) is larger and the ratio (Rn'/Rn) is smaller toward FIG. 16 from FIG. 11.

Referring to FIG. 11 and FIG. 12, it is found that meniscuses with first to third discharge pulses vary largely. Further, referring to FIG. 13 to FIG. 16, it is found that meniscuses with first to third discharge pulses are within a substantially constant level and have preferable recovery characteristics. That is to say, even if ink droplets are discharged with a driving signal having a high frequency of approximately 30 kHz, when the ratio (Sn/Ss) is equal to or larger than 1/3 and the ratio (Rn'/Rn) is equal to or smaller than 0.6, stable discharge characteristics are obtained.

Figure 14:
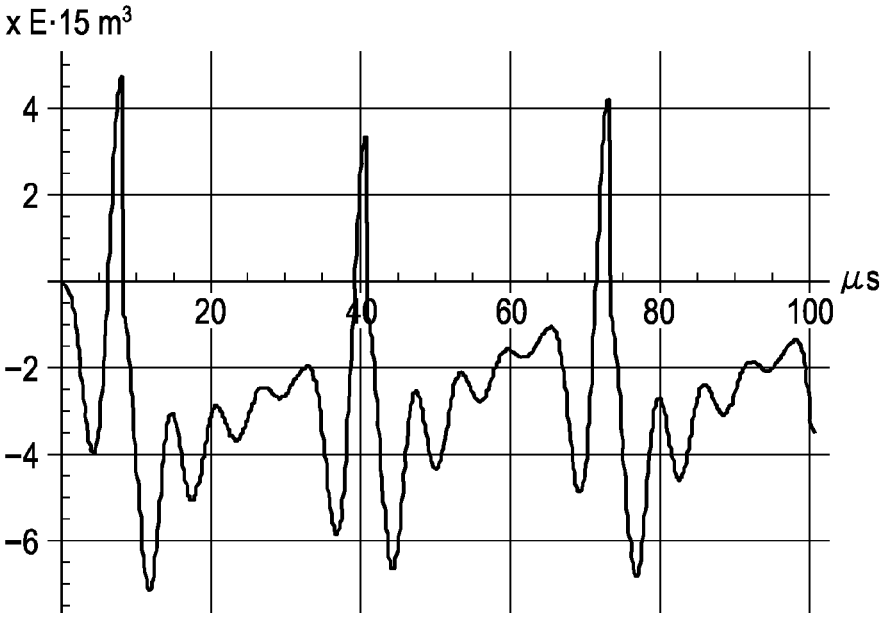
FIG. 14 is a graph illustrating a calculated value of an ink discharge characteristic of the recording head.
Figure 15:
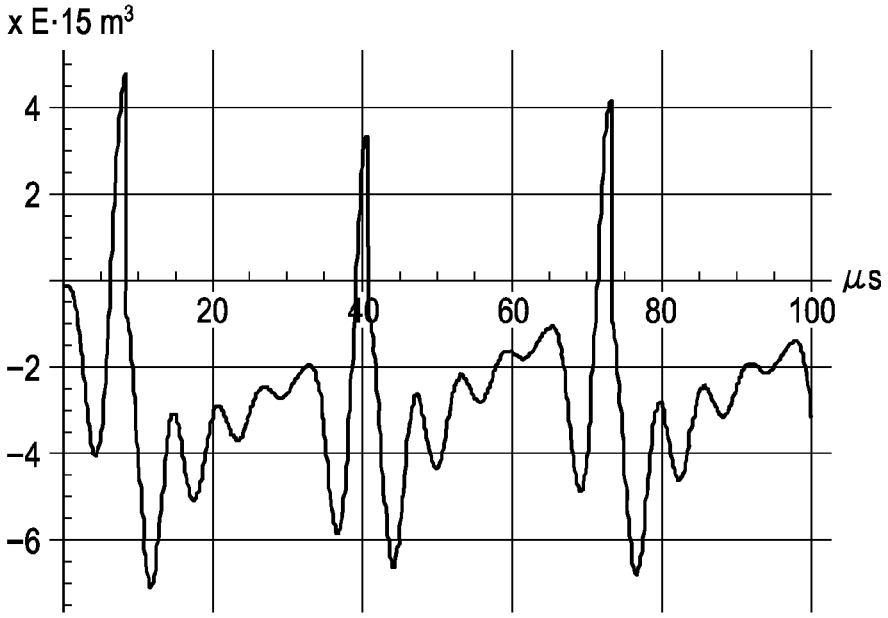
FIG. 15 is a graph illustrating a calculated value of an ink discharge characteristic of the recording head.
Figure 16:
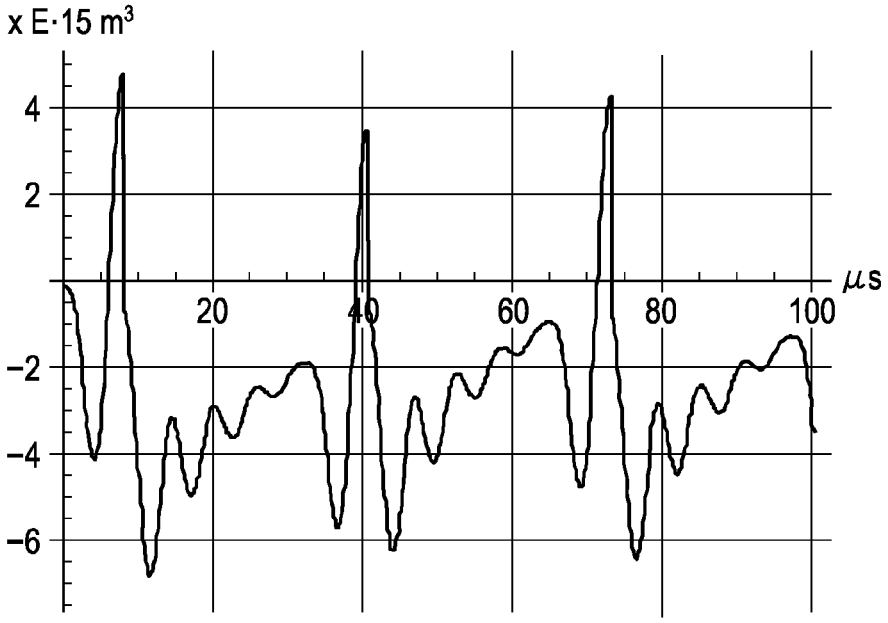
FIG. 16 is a graph illustrating a calculated value of an ink discharge characteristic of the recording head.
Figure 17:
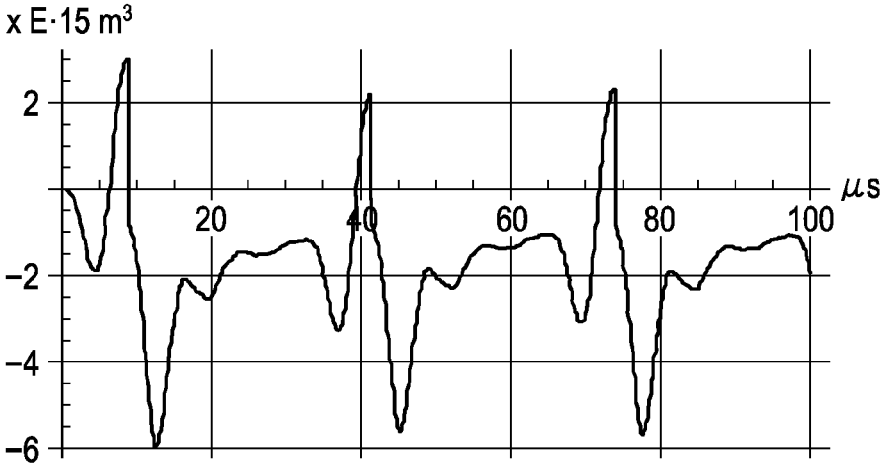
FIG. 17 is a graph illustrating a calculated value of an ink discharge characteristic of the recording head.
Figure 18:
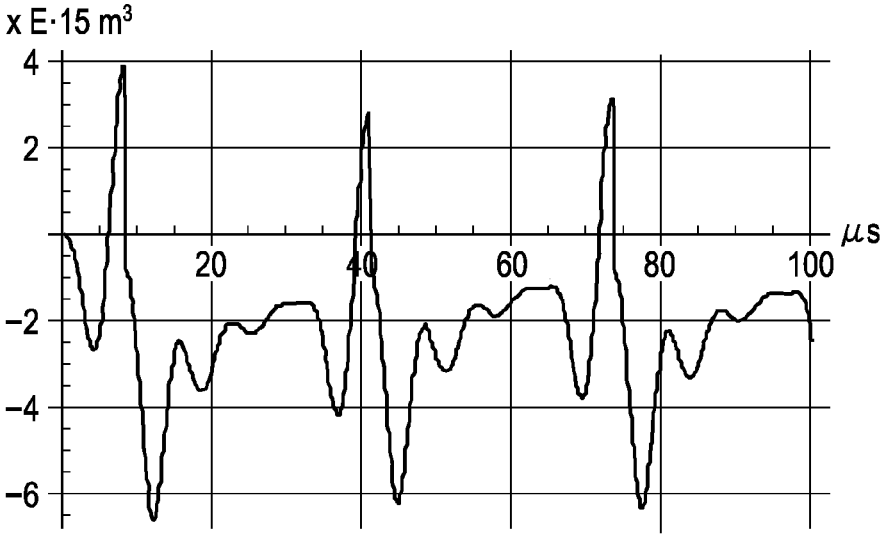
FIG. 18 is a graph illustrating a calculated value of an ink discharge characteristic e of the recording head.
Figure 19:
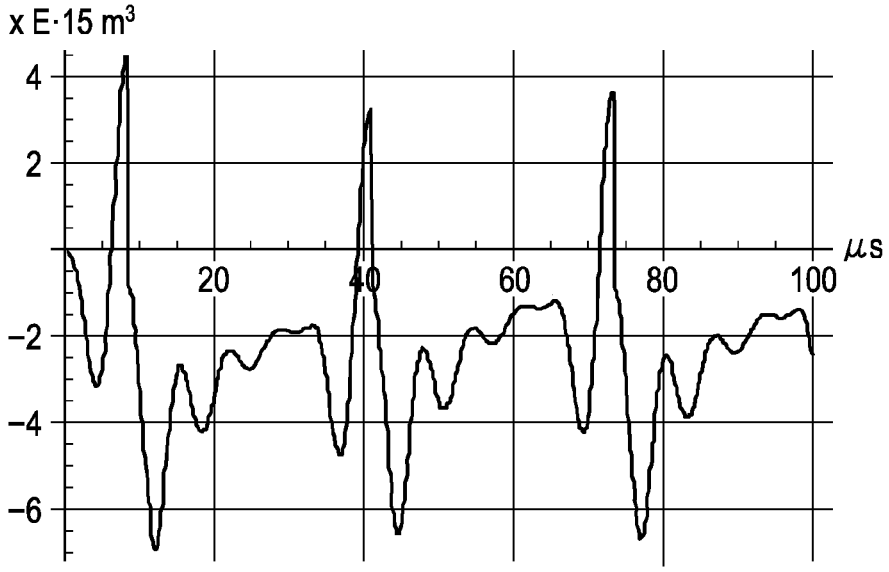
FIG. 19 is a graph illustrating a calculated value of an ink discharge characteristic of the recording head.
Figure 20:
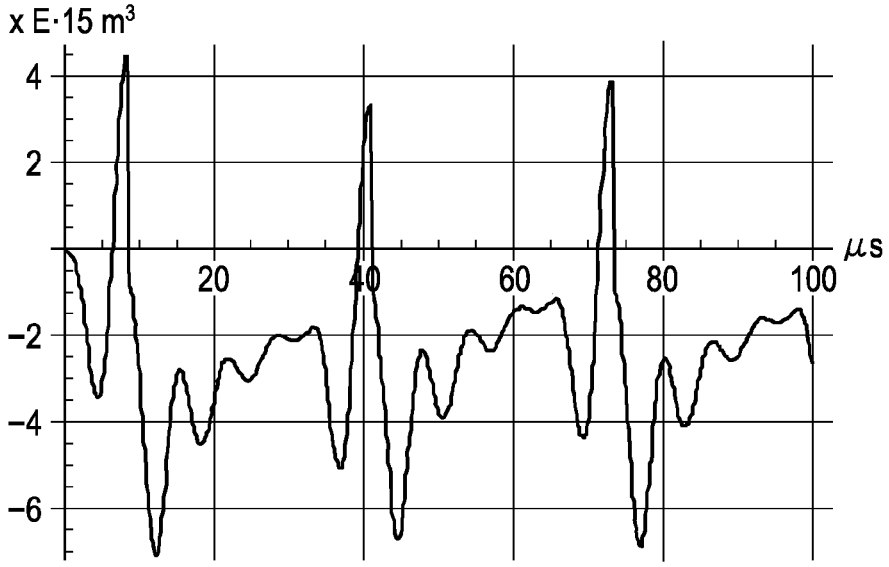
FIG. 20 is a graph illustrating a calculated value of an ink discharge characteristic of the recording head.

FIG. 17 to FIG. 20 are graphs illustrating ink discharge characteristics of the recording head when a magnitude relationship between the inertance Ms of each ink supply path 14 and the inertance Mn of each nozzle portion 21 is changed under the same condition as that in the case of FIG. 14. In FIG. 17 and FIG. 18, Mn is larger than Ms. In addition, in FIG. 17, the inertance Mn is larger than that in FIG. 18. Further, in FIG. 14, FIG. 19 and FIG. 20, Mn is smaller than Ms. Moreover, the inertance Mn is made smaller toward FIG. 19 and FIG. 20 from FIG. 14.

Referring to FIG. 17, a discharge amount is approximately slightly larger than 2 pl. Also in the case of FIG. 18, the discharge amount is smaller than 4 pl. In contrast, in any of the cases of FIG. 14, FIG. 19 and FIG. 20, the discharge amount is sufficiently larger than 4 pl. Such characteristics indicate that if Mn is set to be smaller than Ms, a sufficient discharge amount can be obtained.

Other Embodiments

The embodiment of the invention has been described above. However, a basic configuration of the invention is not limited to the above-described configuration. For example, the recording apparatus I in the above-described embodiment includes piezoelectric actuators using thin film-type piezoelectric elements as pressure generation units for generating pressure change in the pressure generation chambers 12. However, the pressure generation unit is not particularly limited thereto. For example, a thick film-type piezoelectric actuator formed by a method of bonding a green sheet, or the like, a piezoelectric actuator using a longitudinal vibration-type piezoelectric element on which piezoelectric materials and electrode formation materials are alternately laminated so as to be expanded and contracted in an axial direction, or the like, can be used. In this case, ink to be used is not limited to the ink having high viscosity. For example, the same effects are obtained even if the invention is applied to metallic ink containing pigment of flat plate-like particles having the same problem as that in the ink having high viscosity.

Further, in the embodiment as illustrated in FIG. 1, a so-called serial-type ink jet recording apparatus in which the recording head units 1A and 1B are mounted on the carriage 3 which moves in the direction (main scanning direction) intersecting with the transportation direction of the recording sheet S and printing is performed while moving the recording head units 1A and 1B in the main scanning direction is employed. However, the invention is not limited thereto. It is needless to say that the invention can be applied to a so-called line-type ink jet recording apparatus in which a recording head is fixed and printing is performed only by transporting the recording sheet S.

Further, in the above-described embodiment, the ink jet recording apparatus has been described as an example of a liquid ejecting apparatus. However, the invention is widely applied to liquid ejecting apparatuses including liquid ejecting heads and it is needless to say that the invention can be also applied to a liquid ejecting apparatus including a liquid ejecting head which ejects liquid other than ink. As other liquid ejecting heads, various types of recording heads used in an image recording apparatus such as a printer, a color material ejecting head used for manufacturing a color filter such as a liquid crystal display, an electrode material ejecting head used for forming an electrode such as an organic EL display and a field emission display (FED), a bioorganic compound ejecting head used for manufacturing a bio chip, and the like can be exemplified.

What is claimed is:

1. A liquid ejecting head comprising:

a pressure generation chamber to which liquid is supplied through a liquid supply path;

a pressure generation unit that generates pressure change in the pressure generation chamber, and a nozzle portion that causes the liquid to be discharged with the pressure generated by the pressure generation unit, wherein the nozzle portion includes:

a first nozzle portion that communicates with the pressure generation chamber, the first nozzle portion having a cross-sectional area in a direction orthogonal to a discharge direction of the liquid that is a first area and a second nozzle portion, wherein a first side of the second nozzle portion communicates with the first nozzle portion and a second side is a nozzle opening, the second nozzle portion having a cross-sectional area that is a second area, wherein the second area is smaller than the first area wherein the first nozzle portion and the second nozzle portion are continuous through a step portion, and when a cross-sectional area of the liquid supply path in a direction orthogonal to a circulating direction of the liquid is set to Ss, a cross-sectional area of a portion on which the first nozzle portion and the pressure generation chamber communicate with each other is set to Sn, a flow path resistance of the first nozzle portion is set to Rn', and a flow path resistance of the second nozzle portion is set to Rn, relationships of $Sn/Ss \geq 1/3$ and $Rn'/Rn \leq 0.6$ are satisfied.

2. The liquid ejecting head according to claim 1, wherein when an inertance of the liquid supply path is set to Ms and an inertance of the nozzle portion is set to Mn, a relationship of $Mn < Ms$ is satisfied.

3. The liquid ejecting head according to claim 1, wherein the liquid has a discharge viscosity of equal to or higher than 8.0 (mPa·s).

4. A liquid ejecting apparatus comprising the liquid ejecting head according to claim 1.

5. A liquid ejecting apparatus comprising the liquid ejecting head according to claim 2.

6. A liquid ejecting apparatus comprising the liquid ejecting head according to claim 3.

* * * * *